United States Patent [19]

Davis et al.

[11] Patent Number: 4,651,258

[45] Date of Patent: Mar. 17, 1987

[54] RETRACTABLE LIGHT ASSEMBLY

[75] Inventors: John W. Davis, Greenwood; Harvey D. Corley, Cross Hill; Michael P. Boudreau, Greenwood; J. Larry Laughlin, Hodges, all of S.C.

[73] Assignee: Professional Medical Products, Inc., Greenwood, S.C.

[21] Appl. No.: 836,807

[22] Filed: Mar. 6, 1986

[51] Int. Cl.[4] ..... F21M 1/00

[52] U.S. Cl. ..... 362/147; 362/386; 362/419; 362/428; 362/804

[58] Field of Search ..... 362/147, 272, 286, 386, 362/804, 269, 271, 273, 287, 419, 427, 428, 430

[56] References Cited

U.S. PATENT DOCUMENTS

| | | | |
|---|---|---|---|
| 1,938,237 | 12/1933 | Wagenhorst | 362/147 |
| 3,010,013 | 11/1961 | Günther et al. | 362/147 |
| 3,702,928 | 11/1972 | Alger | 362/804 |
| 4,454,569 | 6/1984 | Maguire | 362/287 |

*Primary Examiner*—Andrew M. Dolinar
*Attorney, Agent, or Firm*—Luke J. Wilburn, Jr.

[57] ABSTRACT

A retractable light assembly for use in portions of a room and for hidden storage within the ceiling of the room when not in use, comprising a rigid support frame adapted to be mounted within an opening in and above the ceiling of a room and defining a lower frame opening containing movable panels attached to the frame for movement between a first position closing the frame opening and a second position extending downwardly therefrom into a room. A positionally adjustable lighting fixture mounted on the upper surface of one of the panels is carried thereby from a stored, hidden position in the ceiling into the room for manual positioning and use. An electromechanically-powered linear actuator connecting the frame to the panels is actuated to move the panels and lighting fixture from stored to use position.

8 Claims, 6 Drawing Figures

RETRACTABLE LIGHT ASSEMBLY

The present invention is directed to a light assembly for high-intensity illumination of areas of a room, and more particularly, to a retractable light assembly which may be stored out-of-sight above the ceiling of a room when not in use.

BACKGROUND OF THE INVENTION

High-intensity lighting is widely employed in medical facilities to illuminate desired fields of operatory procedure, such as in operating rooms, examining rooms, birthing or delivery rooms, and the like. Typically, such lights have a high-intensity, light-emitting head portion attached by adjustable support arms to the wall or ceiling of a room. The light-emitting head portion is generally manually positionable through its support arms to provide direct lighting of a desired area of examination.

In the delivery of newborn, it is desirable that the birthing or delivery room have a natural, homelike appearance to provide a reassuring influence for expectant mothers during labor and delivery. It has been known to employ positionally adjustable light assemblies mounted for movement to a storage position when not in use. One such light arrangement consists of an adjustable light assembly mounted on a ceiling trackway for movement from a position of use into a wall cabinet of the room for storage.

OBJECTS OF THE PRESENT INVENTION

It is an object of the present invention to provide a light assembly for illuminating areas of a room, such as an operating or delivery room, which may be retracted and stored hidden from view when not in use, and is readily accessible for use when needed during medical procedures.

It is another object to provide a retractable light assembly particularly adapted for high-illumination of areas of a room, such as a delivery room, wherein the light assembly is retractably stored and hidden from view when not in use in a central, readily accessible ceiling access area of the room.

It is another object of the invention to provide an improved retractable light assembly adapted for storage from view above the ceiling of a room and which may be readily lowered for use by medical personnel through a 360° radius of movement in the room.

It is still a further object of the present invention to provide a retractable, high-intensity light assembly which is readily accessed by motorized means to and from a stored, hidden position above the ceiling for use by medical personnel.

BRIEF DESCRIPTION OF THE DRAWINGS

The above, as well as other objects of the present invention, will become more apparent and the invention will be better understood from the following detailed description of preferred embodiments of the invention, when taken with the accompanying drawings, in which.

BRIEF SUMMARY OF THE INVENTION

The present invention is a retractable light assembly for use in illuminating portions of a room and for storage above the ceiling of the room when not in use, comprising a rigid support frame adapted to be mounted within an opening in and above the ceiling of a room and defining a lower frame opening mounted flush with the ceiling of the room and conforming in shape to the room's ceiling opening. A pair of closure panels are attached to the frame for movement between a first position closing the frame and ceiling opening and a second position extending downwardly therefrom into the room. Supportably mounted on the upper surface of one of the closure panels is an adjustable lighting fixture which is supported and carried by the panel from a stored position in the ceiling downwardly into the room for access and use by medical personnel in medical operatory and examining procedures.

The lighting fixture is thus stored in hidden position by the closure panels above the ceiling of a room when not in use, and power-driven means are provided to open and close the panels and present the lighting fixture into the room for use.

DETAILED DESCRIPTION OF PREFERRED EMBODIMENTS

Figure 1:
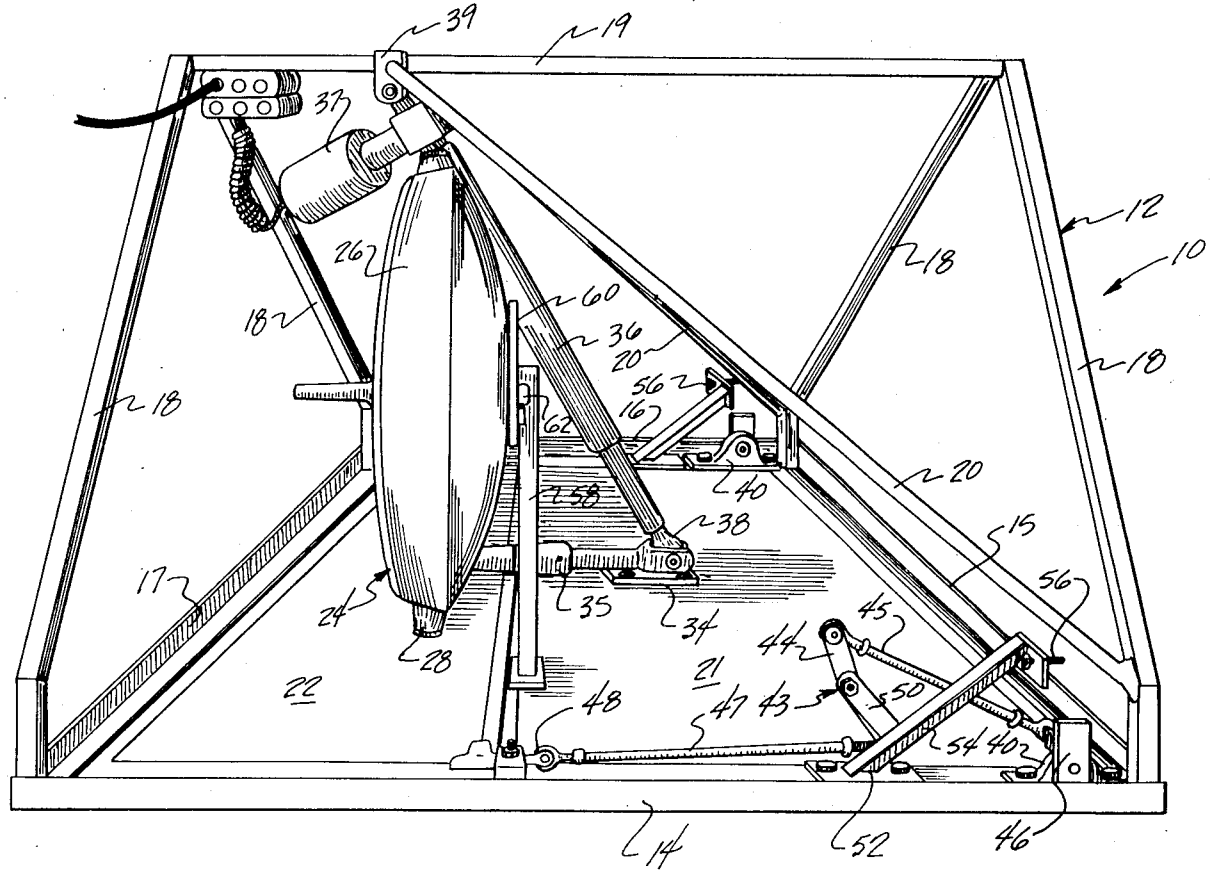
FIG. 1 is a perspective side view of a retractable light assembly of the present invention, showing the light in a stored position within a support frame which is to be mounted within the ceiling of a room.
Figure 2:
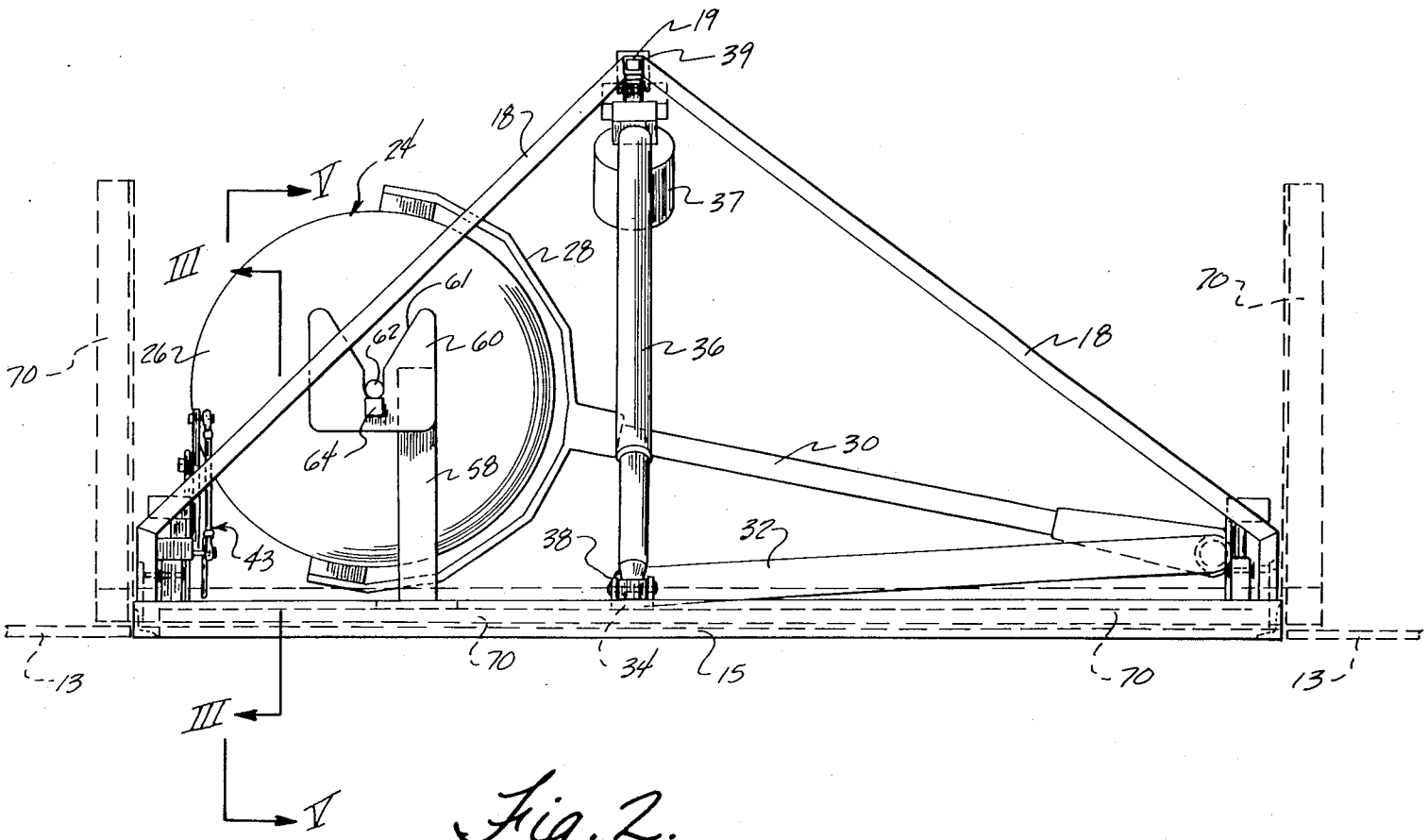
FIG. 2 is a right side elevation view of the light assembly shown in FIG. 1, with additional ceiling support members and ceiling line of the room shown in phantom lines.

As seen in the FIGS. 1 and 2 of the drawings, the retractable light assembly 10 of the present invention comprises a rigid support frame 12 adapted to be mounted flush with and extending above a hung ceiling 13 (FIG. 2) of a room. Frame 12 includes four horizontally disposed rigid frame members 14–17 defining a lower rectangular opening which lies flush with the ceiling line and conforms in shape to a pre-formed opening made therein. The frame 12 of the light assembly may be supported above the hung ceiling 13 (shown in phantom in FIG. 2) by additional framing 70 (shown in phantom) attached and hung from the roof or floor structure above the hung ceiling 13.

Support frame 12 includes rigid frame members 18 which extend upwardly from each corner of the lower frame members 14–17 and interconnect with a horizontal frame member 19 to provide stability and support to the frame. As seen, frame member 19 is spaced above and extends across a central portion of the rectangular opening formed by the lower frame members 14–17 and is further braced by a pair of diagonal rods 20 of the frame.

Supportably mounted on the frame 12 and located in the rectangular opening formed by lower frame members 14–17 are first and second panels 21, 22. Panels 21, 22 are operatively attached to the frame 12 for pivotal movement between a first position closing the lower frame opening (FIGS. 1–3) and a second position (FIGS. 4 and 5) which, when the frame is installed in a room ceiling opening, extends downwardly from the lower frame opening into the room, as will be explained.

The retractable light assembly 10 of the present invention also includes a high-intensity lighting fixture 24 supportably mounted on the upper surface of panel 21. The lighting fixture has a light-emitting head portion 26 which is pivotally mounted in a supporting yoke 28 (FIG. 2) and is connected by first and second support arms 30, 32 (FIGS. 2 and 5) to a base plate 34 attached to the upper surface of panel 21. Yoke 28 is mounted for rotational movement about the longitudinal axis of support arm 30 and support arm 30 is pivotally connected to the end of second support arm 32. The other end of arm 32 is attached by a short shaft which is mounted for 360° rotation in a sleeve bearing 35 attached to base plate 34.

The weight of the head portion 26 of the lighting fixture is counterbalanced in known manner against the force of gravity by suitable counterbalancing means, such as springs, not shown, located inside support arm 30. By use of counterbalancing means in the support arm, the light head portion 26 is designed to be manually positioned and maintained against movement by gravity from its adjusted position while in use. The lighting fixture shown and described is of a commercially available type employed in hospital and medical facilities and designed to be mounted on the wall or ceiling to permit manual movement of the light head portion 26 to a desired position of use during examining or operatory procedures. Typical of such an adjustable medical examining light is a Model ECL 152 operatory light manufactured by ALM Company of Paris, France and distributed in the United States by Professional Medical Products, Inc. of Greenwood, SC. The lighting fixture is electrically wired, in conventional manner, through wiring in its support arms and base to a source of electrical power, such as an electric control box conveniently located in the room of its use.

Figure 5:
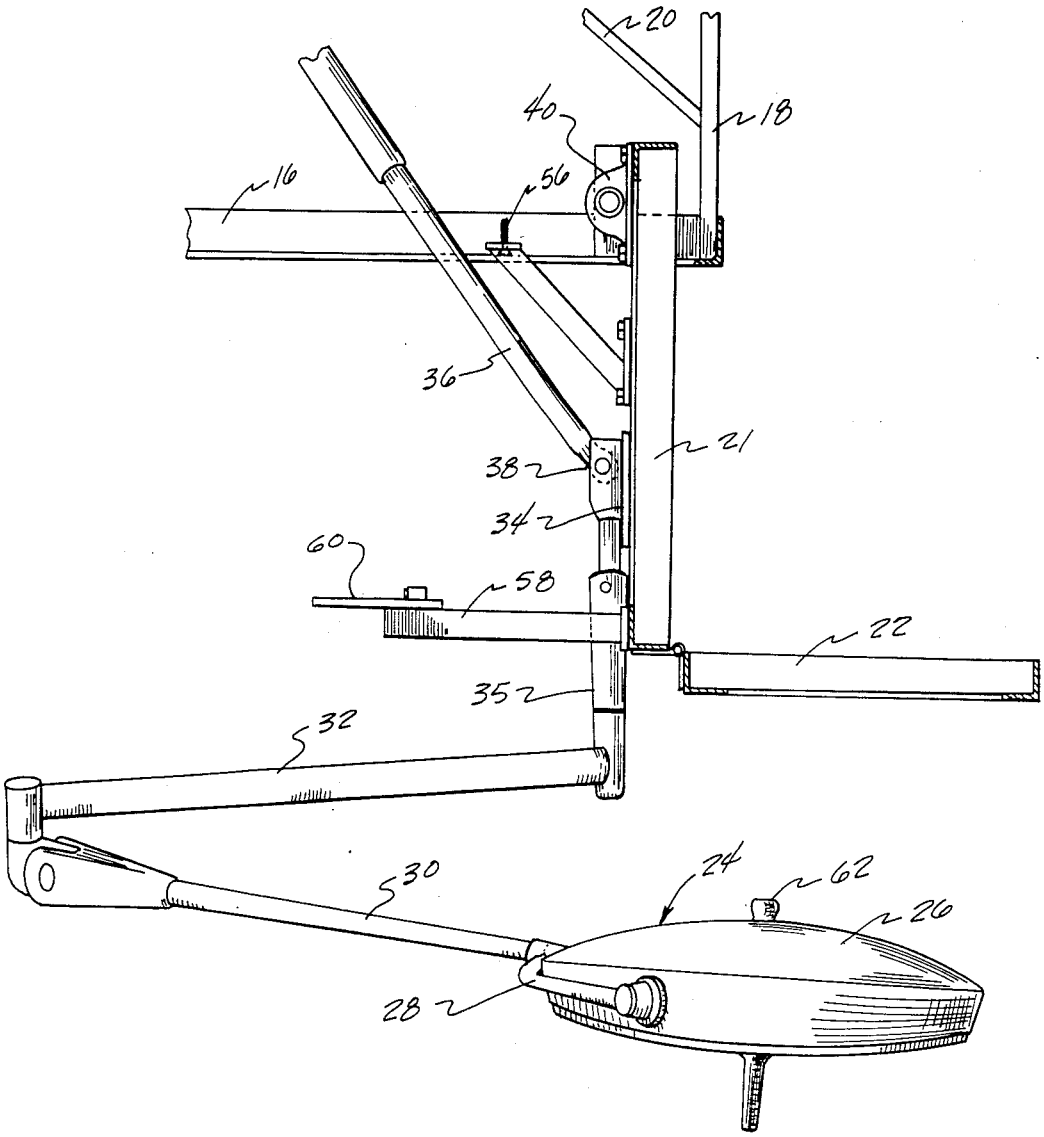
FIG. 5 is a sectional elevation view of the lower right front portion of the light assembly as seen in FIG. 2, taken generally along line V—V of FIG. 2 looking in the direction of the arrows, and showing a portion of the support frame, closure panels in open position, and the lighting fixture of the light assembly positioned for use in a room by personnel in a medical examining or operatory procedure.

As best seen in FIGS. 1, 2, and 5, panels 21, 22 are moved between opened and closed positions in the lower rectangular opening of frame 12 by known electrically-powered drive means, such as an electromechanically operated, extendable and retractable linear actuator 36 with motor 37. The actuator may be a commercially-available Duff-Norton Mini-Pak® electromechanical linear actuator with built-in limit switches to control the limits of movement of the actuator. As seen, the lower end 38 of actuator 36 is pivotally attached to base plate 34 on panel 21, and its upper end is pivotally attached by a bracket 39 to the upper frame member 19 of support frame 12.

As seen in FIGS. 1 and 3–5, the ends of panel 21 are pivotally attached to horizontal frame members 14, 16 by stub shafts journalled in bearings 40. The inner edge of panel 21 is connected by suitable hinge means, such as a piano hinge 42 (FIGS. 3 and 4), to the adjacent side edge of panel 22, such that panel 22 is supportably carried by panel 21 during its pivotal movement by actuator 36. As seen in FIGS. 1–4, movement of panel 22 about its hinged interconnection to panel 21 is produced by means of a bell crank mechanism 43 attached to and interconnecting the two panels.

The bell crank mechanism 43 which operatively interconnects first and second panels 21, 22 comprises an elongate, curved link 44, one end of which is pivotally attached to a connecting rod 45 which is, in turn, pivotally attached to a bracket 46 on frame member 14. The other end of link 44 is pivotally attached to one end of a connecting rod 47, the other end of which is pivotally attached to a bracket 48 mounted on the top edge surface of panel 22. The central portion of link 44 is pivotally attached to an extending arm 50 of a support bracket 52 mounted on a side edge portion of panel 21. Support bracket 52 also has a second arm 54 extending at a 45° angle to panel 21 which forms at its outer end, and adjustable stop means to engage the adjacent frame member 14 and supportably position panel 21 at a right angle to the lower frame members 14 when the panel pivots downwardly to open the frame opening. Note FIG. 4. As shown, the stop means on the end of arm 54 comprises a short plate carrying a threadably adjustable stop member 56 which engages the top surface of frame member 14 to support panel 21 in a vertical plane when the panel is lowered into the room. As seen in FIGS. 1 and 5, the opposite side edge of panel 21 is provided with similar stop means having an adjustable stop member 56 to engage the opposite frame member 16 when the panel 21 is lowered into a room.

As seen in FIGS. 1, 2, and 5, attached by a supporting post 58 extending upwardly from the upper surface of panel 21 is a storage plate 60. One side of storage plate 60 is provided with a V-shaped slot 61 (FIG. 2) to receive a raised knob 62 located on the upper housing of the head portion 26 of the lighting fixture. Storage plate 60 with its V-shaped slot serves to positionally secure the head portion of the lighting fixture when it is placed adjacent the upper surface of panel 21 for storage above the ceiling of a room. Storage plate 60 thus locks the lighting fixture in compact, stored position and prevents movement of the head portion 26 when the fixture is lying in a side disposition, as seen in FIGS. 1 and 2.

To prevent activation of the power-driven actuator 36 and movement of the panels 21, 22 when the lighting fixture 24 is in other than a stored position adjacent the panels, an electrical contact switch 64 (FIG. 2) is located at the base of the V-shaped slot 61 to be engaged by knob 62 on the head portion of the lighting fixture. The switch 64 is connected in conventional manner into the power supply line to the motor 37 of the actuator 36. Unless knob 62 is located in the stop plate slot in engagement with switch 64, eletrical power cannot be supplied to actuator 36 to lift or lower the panels and lighting fixture, thus ensuring that the fixture is in proper retracted position before it is lifted into storage position above the ceiling of the room.

Figure 3:
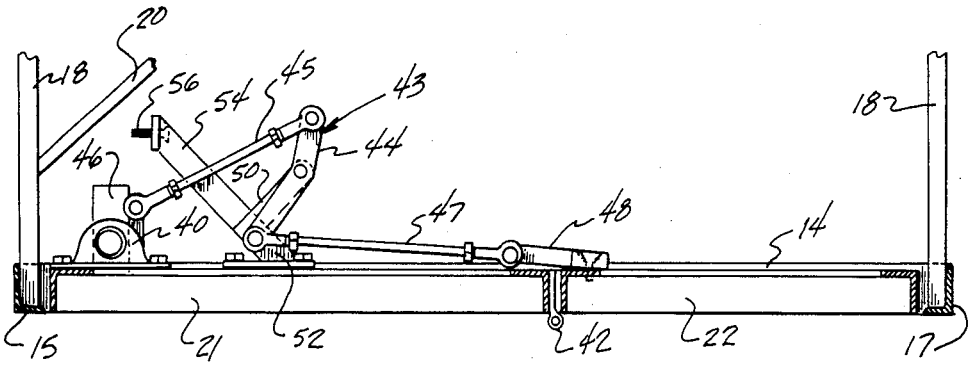
FIG. 3 is a sectional elevation view of the lower left side portion of the supporting frame and closure panels of the light assembly seen in FIG. 2, showing a bell crank mechanism and taken generally along line III—III of FIG. 2 looking in the direction of the arrows.
Figure 4:
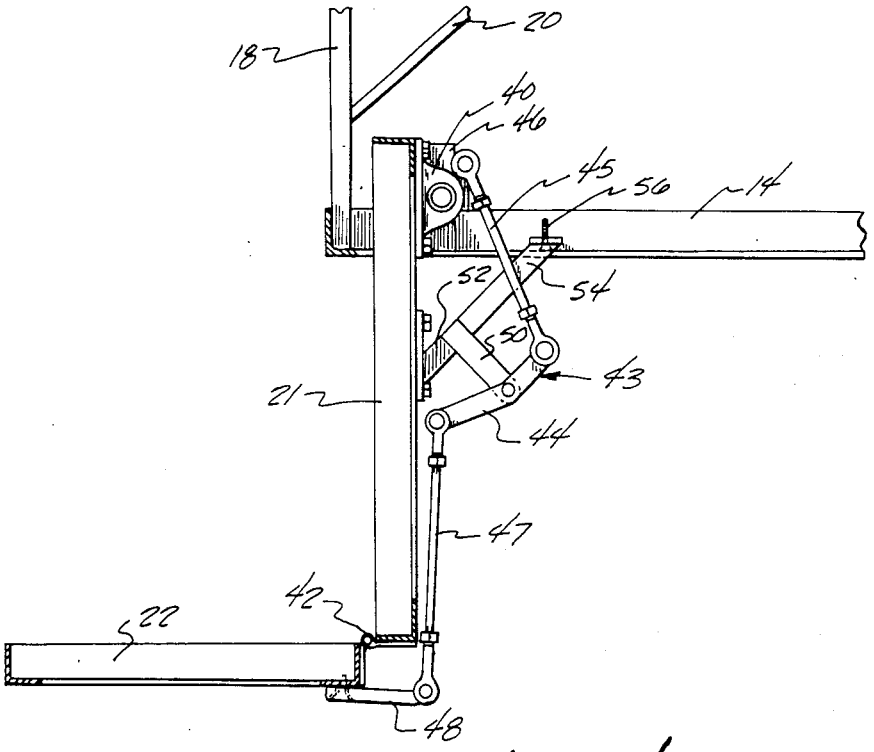
FIG. 4 is a sectional elevation view of the lower left side portion of the light assembly as seen in FIG. 3, but with the closure panels of the light assembly moved to an open position by the bell crank mechanism.

As best seen in FIGS. 3 and 4, bell crank mechanism 43 connecting panels 21 and 22 is designed to mechanically move second panel 22 about its hinged connection to panel 21 when the actuator 36 is operated. As seen in FIGS. 4 and 5, the bell crank operates to pivot and supportably position panel 22 at a right angle to panel 21 when panel 21 is moved downwardly to a right angle position with respect to the support frame opening. Thus, when the panels move downwardly into a room to open the frame opening and bring the lighting assembly into position for use, panel 21 is located in a vertical plane and panel 22 is located in a horizontal plane extending rearwardly of panel 21 and the lighting fixture.

The horizontal positioning of panel 22 thus provides clearance for free rotational movement of the lighting fixture about its supporting base plate and additional head clearance for personnel in the room.

To facilitate installation of the lighting assembly of the present invention in a ceiling of an existing room, additional supporting members 70 (shown in phantom in FIG. 2) may be installed in the ceiling to receive and support the frame 12 of lighting assembly 10. As seen in FIG. 2, such supporting members 70 may comprise an angle iron frame conforming to the outer dimensions of the lower rectangular opening of the assembly support frame, with upstanding legs to be attached to overhead building structure above the ceiling of the room of the building. The support frame 12 of the lighting assembly 10 may then be inserted into the angle iron frame 70 and bolted thereto about its periphery to dispose the lower frame members 14–17 and closure panels 21, 22 flush with the ceiling surface 13, as seen in FIG. 2. If desired, the upper portion of the support frame 12 of the lighting assembly may be enclosed by suitable wall members, such as sheet metal, to protect the lighting assembly in its stored position in the ceiling of a room.

Figure 6:
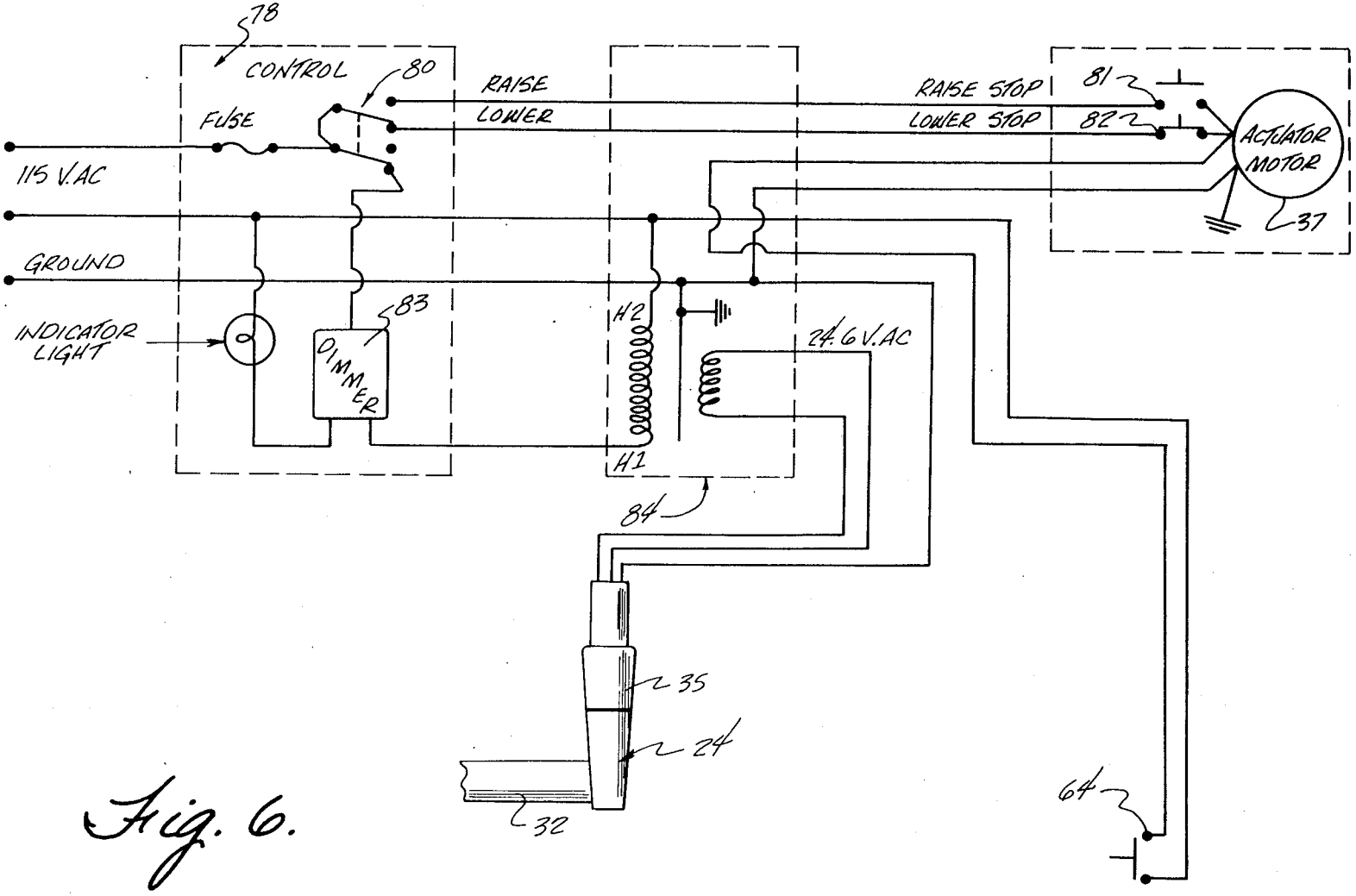
FIG. 6 is a schematic wiring diagram of the electric control circuit for operating the light assembly.

FIG. 6 is a wiring diagram of the electrical control circuit which operates the light assembly. Electrical power is supplied to a control panel or box 78 conveniently located on the wall of a room in which the lighting fixture is to be used. The control box contains a double-pole, double-throw rocker switch 80 which is connected by wires through actuator limit switches 81, 82 to the actuator motor 37 and operated to raise or lower the lighting fixture and closure panels. Limit switches 81, 82 located in the actuator 36 are positionally adjustable in conventional manner to control the limits of movement of the linear actuator in raising and lowering the closure panels 21, 22.

Switch 80 also is connected through wires and a dimmer switch 83 to supply power to the light of the lighting fixture 24 through its sleeve bearing 35 and support arms when the panels and fixture are lowered into the room. The electric circuit further includes the contact switch 64 which must be closed before power can be supplied to the motor 37 of actuator 36. A transformer 84 is located in the electrical circuitry to convert AC power to DC for operation of the lighting fixture.

From the foregoing, it can be seen that the improved lighting assembly of the present invention may be employed in medical examining, operating, and delivery rooms, and located at a convenient place in the ceiling for easy access by medical personnel, and for ready storage when not in use.

That which is claimed is:

1. A retractable light assembly for use in illuminating portions of a room and for storage above the ceiling of the room when not in use, comprising a rigid support frame adapted to be mounted within an opening in and above a ceiling of a room and defining a lower frame opening conforming in shape to the room ceiling opening, panel means attached to the frame for movement between a first position closing the frame opening and a second position extending downwardly therefrom into the room, light means mounted on the upper surface of the panel means to be carried thereby from a stored position above the room ceiling when the panel means is in said first position and into a room for use when the panel means is in said second position, said light means comprising a light-emitting head portion and means attaching the head portion to said panel means for adjustable manual positioning of the head portion relative to the panel means within the room to illuminate portions of the same and for retractable storage of the head portion adjacent the upper surface of the panel means, and means for moving the panel means and light means between said first and second positions.

2. A light assembly as defined in claim 1 wherein said panel means comprises first and second panels pivotally attached to the frame for movement between said first and second positions to open and close the frame opening and the ceiling opening of a room.

3. An illuminating light assembly as defined in claim 2 wherein said light means is supportably mounted on the upper surface of said first panel, and said means for moving the panels between said first and second positions includes means for positioning said first panel in a substantially vertical plane when in said second position.

4. A retractable light assembly as defined in claim 3 including means on said first panel for engaging said head portion of said light means when retracted adjacent the upper surface of the panel means to fix the position of said head portion and light means relative to said first panel during storage and during movement of said panel means between said first and second positions.

5. A retractable light assembly as defined in claim 4 including means engagable by said light means head portion to prevent movement of said first and second panels by said means for moving said panels when said head portion is not in said position for retractable storage.

6. A light assembly as defined in claim 3 including stop means on said first panel engagable with said frame for supportably maintaining said first panel in a substantially vertical position when said panel means are in said second position.

7. A light assembly as defined in claim 2 including means pivotally attaching a side of said first panel to said frame for pivotal movement between said first and second positions, means pivotally attaching said second panel to the opposite side of said first panel to be carried by said first panel during movement between said first and second positions, and mechanically operating means interconnecting said first and second panels to position and maintain said second panel at a substantially right angle to said first panel when said panel means are in said second position, and wherein said means for moving the panel means between said first and second positions comprises power-operated linear actuator means interconnecting said first panel to said frame for moving said first and second panels between said first and second positions.

8. A light assembly as defined in claim 7 wherein said linear actuator means includes limit switch means associated therewith for stopping said actuator means when said first and second panels reach said first and second positions.

* * * * *